US009532673B2

(12) United States Patent
Schoonover et al.

(10) Patent No.: US 9,532,673 B2
(45) Date of Patent: Jan. 3, 2017

(54) RINSE HANGER

(71) Applicant: REEFLECTION, LLC, Vista, CA (US)

(72) Inventors: Joshua S. Schoonover, Carlsbad, CA (US); Eric Robert Young, La Mesa, CA (US)

(73) Assignee: REEFLECTION, LLC, Carlsbad, CA (US)

( * ) Notice: Subject to any disclaimer, the term of this patent is extended or adjusted under 35 U.S.C. 154(b) by 0 days.

(21) Appl. No.: 14/940,080

(22) Filed: Nov. 12, 2015

(65) Prior Publication Data

US 2016/0066730 A1 Mar. 10, 2016

(51) Int. Cl.

| | |
|---|---|
| ***A41D 27/22*** | (2006.01) |
| ***A47G 25/20*** | (2006.01) |
| ***A47G 25/32*** | (2006.01) |
| ***A47G 25/36*** | (2006.01) |
| *A47G 25/14* | (2006.01) |

(52) U.S. Cl.

CPC ..... *A47G 25/20* (2013.01); *A47G 25/32* (2013.01); *A47G 25/36* (2013.01); *A47G 2025/1485* (2013.01)

(58) Field of Classification Search

CPC ..... A47G 25/20; A47G 25/32; A47G 25/36; A47G 2025/1485

See application file for complete search history.

(56) References Cited

U.S. PATENT DOCUMENTS

| | | | | | |
|---|---|---|---|---|---|
| 1,984,631 | A * | 12/1934 | Coss | A47G 25/56 | 53/241 |
| 4,221,298 | A * | 9/1980 | Wright | E05B 69/006 | 211/4 |
| 4,592,497 | A * | 6/1986 | Georges | F26B 9/003 | 223/69 |
| 4,949,739 | A | 8/1990 | Ryan | | |
| 4,989,624 | A | 2/1991 | Darling | | |
| 4,997,000 | A * | 3/1991 | Feast | D06F 18/00 | 134/102.3 |
| 5,037,487 | A | 8/1991 | Santos | | |
| 5,503,311 | A * | 4/1996 | Chen | A47G 25/32 | 223/85 |
| 5,941,429 | A * | 8/1999 | Koons | A47G 25/442 | 223/85 |
| 8,789,729 | B2 * | 7/2014 | Beckett | D06F 59/02 | 223/120 |

(Continued)

*Primary Examiner* — Nathan Durham
(74) *Attorney, Agent, or Firm* — Coastal Patent Law Group, P.C.

(57) ABSTRACT

The disclosure concerns a rinse hanger for rinsing a wetsuit thereon. The rinse hanger is differentiated by a hook and cap assembly configured to provide swivel function; longitudinal grooves for improved structural support and weight displacement; a male adapter extending along a longitudinal axis; the hanger body being symmetrical about the longitudinal axis; and other features as described herein. A user hangs a wetsuit on the hanger and places the hook end of the hanger on a structural support, a quick release connector and hose is then coupled to the hanger and water flow is communicated through holes in the hanger body to rinse the inside of the wetsuit. The quick release connector and hose are removed, and a spray nozzle is coupled to the quick connector and hose, the spray nozzle is used to rinse an outside of the wetsuit. The hanger is then hung for drying and storage.

15 Claims, 9 Drawing Sheets

(56) References Cited

U.S. PATENT DOCUMENTS

| | | | |
|---|---|---|---|
| 8,875,961 | B1 | 11/2014 | Watson |
| 2005/0274751 | A1 | 12/2005 | Plumley |
| 2006/0226177 | A1 | 10/2006 | McJunkin |

* cited by examiner

RINSE HANGER

TECHNICAL FIELD

This invention relates to articles of manufacture for hanging wetsuits and other garments, such articles being commonly referred to as "hangers"; and more particularly, to a hanger configured for rinsing, drying and storing the wetsuit or other garment.

BACKGROUND ART

Many historians believe that President Thomas Jefferson invented the wooden clothes hanger in the late eighteenth century. Since then, a myriad of hanger designs have become commercially available.

With the advent of the wetsuit, sometime in the mid 1950's, came a need for a hanger that was adapted to hold the relatively heavy wetsuit (heavier than typical garments), which can weigh up to about 25 pounds when saturated with water (wet), or sometimes more!

In the last fifty years or so, many wetsuit-specific hangers have become commercially available or otherwise proposed in the art. Early introductions focused on material strength for supporting the weight of a wetsuit. More modernly, however, other hangers have been introduced which suggest solutions to other problems associated with the care of wetsuits.

For example:

Ryan, U.S. Pat. No. 4,949,739, issued Aug. 21, 1990, discloses a "WETSUIT WASHING HANGER DEVICE"; hereinafter referred to as "Ryan". The hanger disclosed by Ryan does not include a hanger hook but instead includes a bent wire configured to attach with a shower head, whereby the shower head is utilized as a source for water flow introduced into the hanger and directed toward a wetsuit hanging thereon.

Darling, U.S. Pat. No. 4,989,624, issued Feb. 5, 1991, discloses a "WETSUIT WASHER"; hereinafter referred to as "Darling". The hanger disclosed by Darling includes two parallel cross arms, one arranged above another, a top cross arm is configured to communicate water downwardly spraying through holes therein, whereas the bottom cross arm is configured to hold the wetsuit.

Santos, U.S. Pat. No. 5,037,487, issued Aug. 6, 1991, discloses a "SPRAY HANGER FOR WET SUIT"; hereinafter referred to as "Santos". The hanger in Santos appears to include a series of PVC type tubing and connectors arranged to form a three dimensional sprinkler system, wherein as best understood a wetsuit is placed on the hanger of Santos and water is communicated to rinse the inside. While the concept of a rinse hanger is communicated in Santos, this disclosed hanger is something that would be home-made. The hanger of Santos is quite rudimentary and cumbersome, and lacks the manufacturability and distribution/shipping capability of a commercially viable product.

Plumley et al., US 2005/0274751, published Dec. 15, 2005, discloses a "WETSUIT RINSING HANGER"; hereinafter referred to as "Plumley". While Plumley describes a product concept resulting in a hanger that at least conceptually suggests the ability to rinse a wetsuit hanging thereon, the disclosure is not enabling such that a manufacturer might make and use the product. For example, those with skill in the art, upon review of the Plumley disclosure, would question inter alia how the product is molded, what type of plastic molding process, what do the molds look like, what material is used to make the hanger?, etc. As best understood, the product described in Plumley has never been manufactured for the reason that it is either (i) not manufacturable; or (ii) manufacture of the product is cost prohibitive. While Plumley discloses the concept of a wetsuit rinsing hanger, the disclosure is not enabling such that one with skill in the art can make and use the disclosed product. Other problems with the product described in Plumley include: (i) lack of surface area support which results in wetsuit shoulder fatigue and failure; (ii) as disclosed the hanger hook, when pressed into the hanger body, will penetrate the hanger body thereby resulting in product failure, diminished water flow, low pressure at spray holes, etc.

While none of these wetsuit rinsing hangers disclosed in the patent art has experienced commercial success, there are a handful of wetsuit hangers that currently represent the bulk of mainstream wetsuit hanger sales. Accordingly, those hangers defining the current state of the art include:

McJunkin, US 2006/0226177, published Oct. 12, 2006, discloses a "WETSUIT HANGER DRYER"; hereinafter referred to as "McJunkin". McJunkin discloses a hanger that includes a fan built inside of the hanger and adapted to generate a flow of air for circulation within the volume of the wetsuit hanging thereon such that the wetsuit might dry faster.

Watson, U.S. Pat. No. 8,875,961, issued Nov. 4, 2014, discloses a "WETSUIT HANGER"; hereinafter referred to as "Watson". The hanger system disclosed in Watson is merely a pair of bent bars attached to a wall, the bars can be individually adjusted to extend outwardly or downwardly from the wall, wherein a wetsuit can be folded over the hanger bars and stored for drying.

Finally, while not known to be in the patent art, probably the most common wetsuit hanger of the current commercially available hangers is the HangPro™ "SlideHanger", which can be further reviewed online at: http://www.thehangpro.com/slidehangeraspx. The SlideHanger is a monolithic one-piece molded hanger body having a hook and an arm extending from the hook and bent about a one hundred eighty degree bend, wherein a wetsuit is folded at or near the waist and slid over the bent arm of the SlideHanger. Those having skill in the art would likely agree that the SlideHanger is the current state of the art in commercially available wetsuit hangers.

However, at least O'Neill wetsuits, currently one of the largest wetsuit manufacturers in the World, and XTERRA wetsuits, in their respective instruction guides for wetsuit care, each suggests that a wetsuit should not be folded on a hanger or otherwise. Thus, while the SlideHanger may be the commercial state of the art, there is a long felt and continued need for an improved wetsuit hanger.

While the above discussion is centered on wetsuits, such as those worn by surfers, divers, triathletes, and other active aquatic activity participants, the contents and discussion of this document can be similarly applied to other garments which might benefit from a structural support and rinse capability in a hanger. Such related problems and other applications will be easily recognized by those having skill in the art of sporting garments and active wear. Therefore, the discussion of the background art is not intended to be used to limit the scope of the herein-described invention.

SUMMARY OF INVENTION

Technical Problem(s)

There is a long felt and continued need for an improved wetsuit hanger that is configured to address at least the following problems:

(i) it is cumbersome to rinse or wash a wetsuit using conventional practices (dipping in bucket, repeated spraying and reconfiguring the wetsuit inside out, etc.);

(ii) storing a wetsuit on a hanger which lacks sufficient surface area leads to premature wetsuit wear and failure;

(iii) hangers must be rigid enough to withstand the weight of up to about 25 pounds in order to be useful for wetsuits;

(iv) hangers for wetsuits must be capable of cost-effective manufacture and distribution/transportation;

(v) hangers without swivel hooks are not ideal for the reason that rotation on the hanger is a desirable feature, especially while rinsing the wetsuit, however, swivel hooks are generally pressed into a hanger body thereby having a propensity to puncture a hollow molded hanger body such as a rinse hanger; and (vi) an ideal hanger will be useful to wash or rinse a wetsuit, hang the wetsuit for drying, and further hang the wetsuit for storage, without cumbersome operation and unnecessary fatigue/stress on the wetsuit fabric.

Solution to Problem(s)

The disclosure concerns a wetsuit rinse hanger having a swivel hanger hook, a broad surface area for distributing the weight of the wetsuit, a hollow hanger body designed to communicate water through holes for rinsing the inside of the wetsuit, and an adapter for quick connection of a water hose connector for providing a source of water flow through the rinse hanger.

Using the rinse hanger disclosed herein, a wearer would remove the wetsuit and hang on the rinse hanger, then place the hanger on the end of an open garage door or other stationary object. A garden hose with a female quick connector attached therewith is then attached to the male adapter of the rinse hanger. The female quick connector preferably includes an auto-stop mechanism such that when removed, the water flow through the female connector is automatically stopped. After a minute or so of rinsing the inside portion of the wetsuit, the female quick connector is removed from the hanger, as mentioned the flow of water is preferably then stopped, and a standard garden hose sprayer (or "spray nozzle") with male adapter is then coupled with the female quick connector, wherein the garden hose sprayer is now used to rinse the outside of the wetsuit. Being rinsed both inside and out, the rinse hanger and wetsuit hanging thereon can be placed for drying and storage. Using the rinse hanger disclosed herein, rinsing or washing a wetsuit is simple, fast and efficient. Moreover, drying and storing the wetsuit on the hanger is improved by the broad surface area of the shoulder portions of the rinse hanger. While the hanger body is hollow, it has a wall thickness sufficient to hang fifty pounds or more.

A distinguishing feature of the disclosed rinse hanger is the swivel hook assembly. The rinse hanger includes a threaded cap with an aperture disposed through an axial center of the cap. The hanger hook includes a flanged bottom end and an optional washer is provided to displace weight about the hook and cap assembly. The hanger body further includes a threaded portion configured to receive the threaded cap, wherein an annular cap seal is included therebetween and used to form a friction seal between the threaded cap and the threaded portion of the hanger body. In this regard, the swivel hook is attached external to the hanger body and introduces no propensity to puncture therethrough.

Another distinguishing feature is a channel extending through the threaded portion of the hanger body of the rinse hanger. The channel provides a recessed volume for the flanged end of the hook to protrude and nest into while not puncturing or wearing against the hanger body.

Another distinguishing feature of the rinse hanger is the filleted neck portion of the hanger body and the longitudinal grooves. Due to the relatively heavy weight associated with a wetsuit, especially when wet, most plastic hanger bodies deform or otherwise lack the structural capability to support the heavy wetsuit. The filleted neck portion and longitudinal grooves of the disclosed rinse hanger have been shown to distribute stress caused by the weight of a wetsuit for providing improved rigidity and stability of the hanger body.

Yet another distinguishing feature of the disclosed rinse hanger is the symmetric plane extending along the length of the hanger body provides an ability to mold the hanger from plastic material. In particular, the hanger can be injection molded, or more preferably, rotation molded (blow molded). Note that the male adapter extends in the longitudinal plane forming a symmetry along the longitudinal axis of the rinse hanger. This symmetry provides the ability to mold the hanger body for low cost and efficient manufacturing.

These and other features and solutions will be further understood upon a review of the following detailed description of embodiments.

Advantageous Effects of Invention

The disclosed rinse hanger includes a hook and cap assembly that is capable of attaching to the rinse hanger for providing a swivel hook which does not protrude into the hanger body itself. Instead, the hook and cap assembly, combined with the threaded portion of the hanger, provide a mechanism for promoting swivel hook function while not puncturing into the hanger body itself. The effect of the resulting swivel hook is advantageous because when spraying the outside of the hanging wetsuit with a garden hose spray nozzle it is advantageous to rotate the hanging wetsuit thereby improving the ergonomics and efficiency of the wetsuit rinsing process.

Moreover, the channel disposed in the threaded portion of the hanger body provides a volume for receiving the flanged portion of the hanger hook such that the hanger hook does not drill into or otherwise penetrate into the hanger body.

The resulting hanger body is symmetrical and capable of plastics manufacturing, in particular injection molding, or more preferably using a rotational molding process. When injection molded, the hanger body is molded in two pieces bisected along the longitudinal plane, then using a solvent bond the two pieces are bonded together. Alternatively, the hanger body is rotational molded as a monolithic piece and the male adaptor aperture and hanger body spray holes are subsequently drilled or otherwise removed. The result is low-cost and efficient manufacturability of the disclosed hanger body.

The broad shoulder surface area displaces the wetsuit shoulders for reducing stress on the wetsuit material and providing longevity and improved storage.

DESCRIPTION OF EMBODIMENTS

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily obvious to those of skill in the art upon a thorough review hereof. Accordingly, any reviewer of the instant disclosure should interpret the scope of the invention by the claims, and such scope shall not be limited by the embodiments disclosed herein.

Now turning to the drawings, FIGS. 1-8 show the rinse hanger in accordance with a preferred embodiment.

Figure 1:
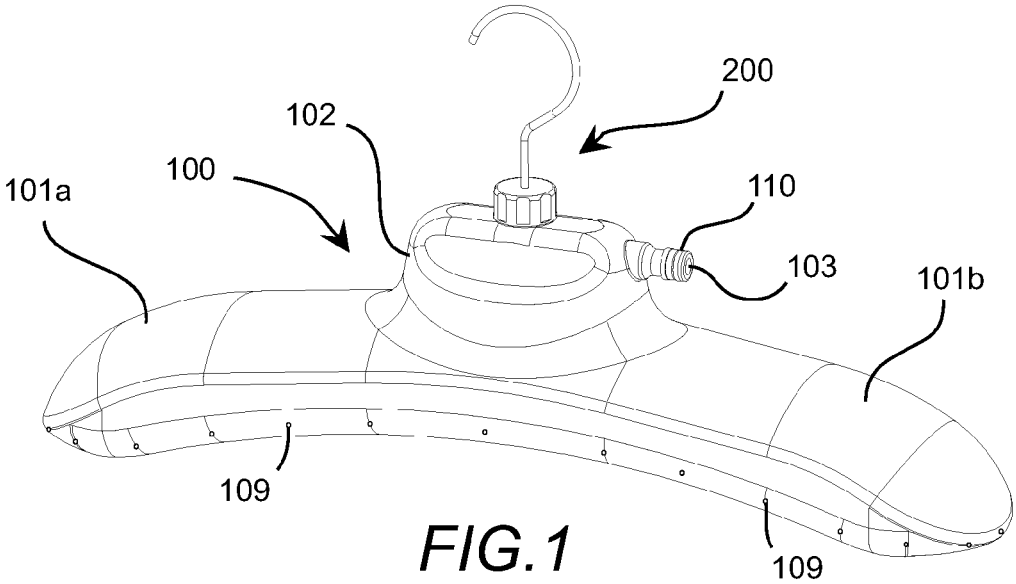
FIG. 1 shows a first perspective view of a rinse hanger in accordance with an embodiment.

FIG. 1 shows a first perspective view of a rinse hanger in accordance with an embodiment. The rinse hanger is shown including a hanger body 100 and a hook and cap assembly 200 attached to the hanger body. The hanger body is configured with broad shoulder portions 101*a*; 101*b*, with one broad shoulder portion on each respective side of the hanger, and is further configured with a male adapter 103 extending outwardly from a neck portion 102 of the hanger body, the male adapter being configured to couple with a quick release female connector and garden hose (not shown). The broad shoulder portions can be any size, but in the preferred embodiment the broad shoulder portions are between about 3 inches and 6 inches wide, and more preferably about 4 inches wide, and in addition, the broad shoulder portions are generally curved to mimic the shoulders of a wearer of the wetsuit such that a larger surface area is provided. The hook and cap assembly is configured with a swivel hook function for providing rotation of the hanger body about the hanger hook. The hanger body further comprises a plurality of holes 109, with each of the holes disposed about a surface of the hanger body and configured to provide a water jet or spray function such that the collection of hanger body holes functions to rinse the inside surface of a wetsuit or other garment hanging on the hanger body.

The rinse hanger is configured such that a user may hang a wetsuit on the rinse hanger; hang the hook of the rinse hanger about an structural object (for example the end of an open garage door), connect a female quick connector and garden hose to the male adapter of the hanger body such that water from the garden hose is communicated into the hanger body through the male adapter and further communicated through the holes of the hanger body creating a spray function for rinsing an internal surface of the hanging wetsuit. After about a minute or so, the user may then disconnect the female quick connector from the hanger body, attach a standard sprayer or spray nozzle to the female quick connector and proceed to rinse the exterior surface of the wetsuit. Subsequent to rinsing the inside and outside of the wetsuit, the wetsuit is left to hang on the hanger for an air drying, and further hung for long term storage.

An O-ring 110 is attached to the male adapter for providing a seal with a female quick release connector when coupled therewith.

Figure 2:
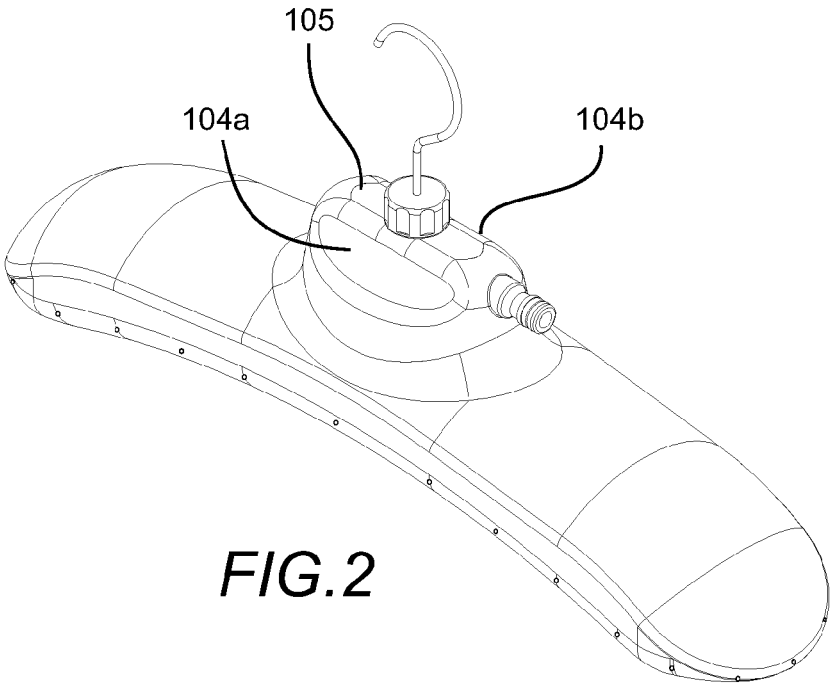
FIG. 2 shows a second perspective view of the rinse hanger.

FIG. 2 shows a second perspective view of the rinse hanger. The filleted neck portion further comprises longitudinal grooves 104*a*; 104*b* extending between the filleted neck portion of the hanger body and the longitudinal base portion 105. Each of the longitudinal grooves is symmetrically disposed on either side of the longitudinal base portion. Moreover, the longitudinal base portion extends along the longitudinal axis of the hanger body. The longitudinal grooves 104, base 105 and filleted neck portion 102 collectively provide a rigid structure for attaching the hook and cap assembly, with the rigid structure being configured to distribute up to fifty pounds or more of a wetsuit without deforming the hanger body.

Figure 3:
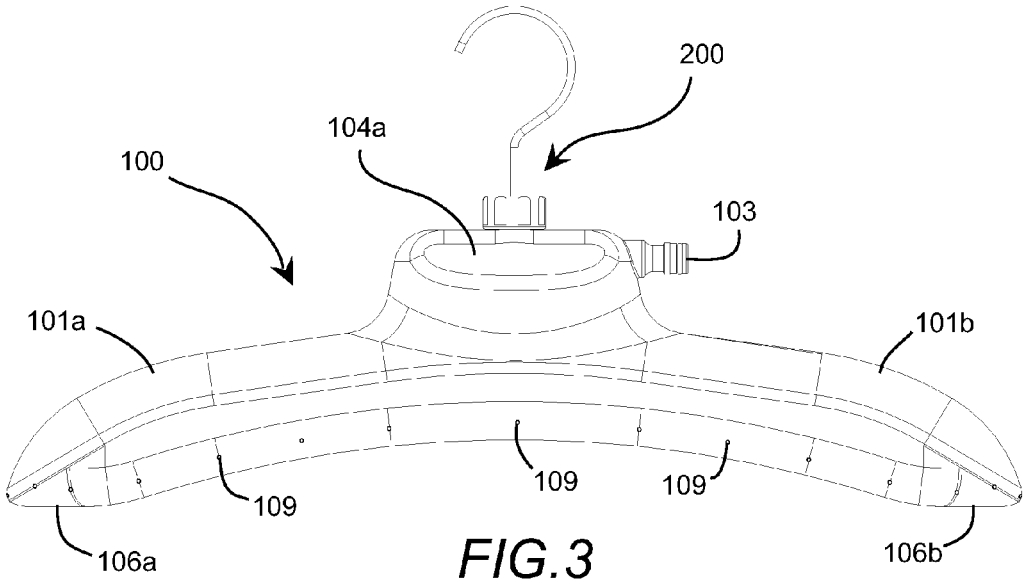
FIG. 3 shows a front view of the rinse hanger.

FIG. 3 shows a front view of the rinse hanger. As shown in FIG. 3, the hanger body of the rinse hanger includes flat bottom ends 106*a*; 106*b* with one of the flat bottom ends at each opposing end of the hanger body. Also shown in FIG. 3 is a first of the longitudinal grooves 104*a*, the male adapter 102, shoulder portions 101*a*; 101*b*, and the hook and cap assembly 200 being attached to the hanger body 100. Holes 109 are disposed along a bottom periphery of the hanger body. Although the holes are shown in a particular pattern and arrangement, any number of holes and any pattern may be implemented to provide the spray function for rinsing the inside of a wetsuit. Likewise, any size hole that will communicate a stream of water flowing therethrough can be used, though in a preferred embodiment the hole diameter can be between about $1/32^{nd}$ and $1/16^{th}$ of an inch.

Figure 4:
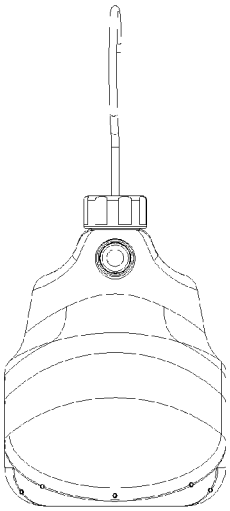
FIG. 4 shows a right view of the rinse hanger.

FIG. 4 shows a right view of the rinse hanger. The rinse hanger is shown looking along the longitudinal axis (through the page). Note the hanger body is symmetrical about a vertical plane extending along the longitudinal axis, otherwise referred to herein as the "longitudinal plane".

Figure 5:
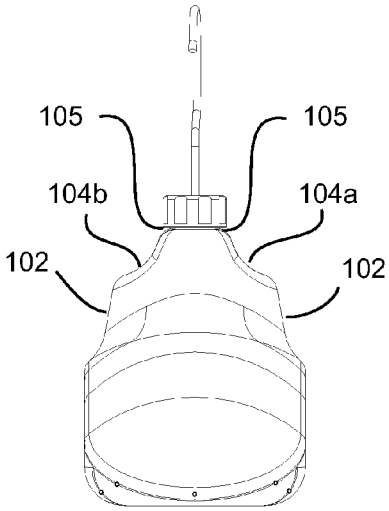
FIG. 5 shows a left view of the rinse hanger.

FIG. 5 shows a left view of the rinse hanger. The rinse hanger is further shown extending along the longitudinal axis and being symmetrical along the vertical longitudinal plane. The longitudinal grooves 104*a*; 104*b* are shown in FIG. 5, wherein each of the longitudinal grooves is coupled to the filleted neck portion 102 at a bottom end thereof and further coupled to the longitudinal base portion 105 along a top end.

Figure 6:
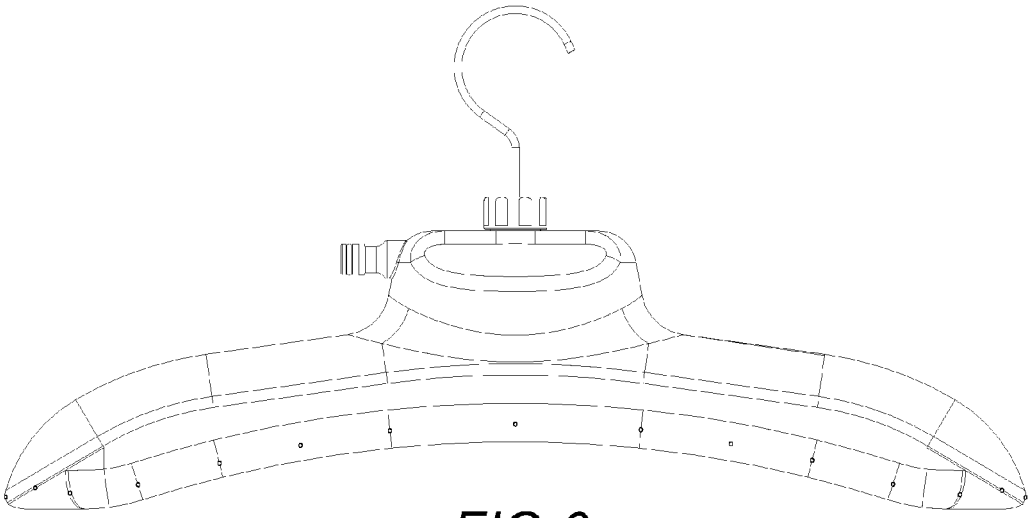
FIG. 6 shows a rear view of the rinse hanger.

FIG. 6 shows a rear view of the rinse hanger. The rear side of the rinse hanger is a mirror image of the front side as shown in FIG. 3.

Figure 7:
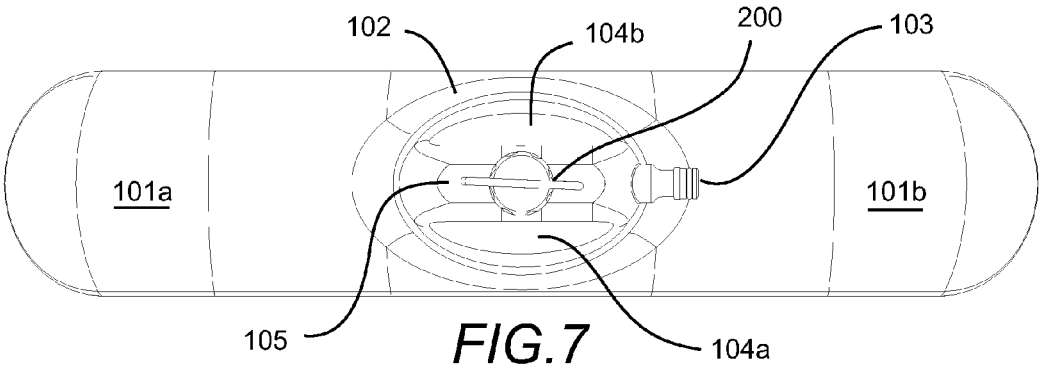
FIG. 7 shows a top view of the rinse hanger.

FIG. 7 shows a top view of the rinse hanger. Each of the hook and cap assembly 200, longitudinal grooves 104*a*; 104*b*, male adapter 103, broad shoulder portions 101*a*; 101*b*, filleted neck portion 102, and the longitudinal base portion 105 are shown.

Figure 8:
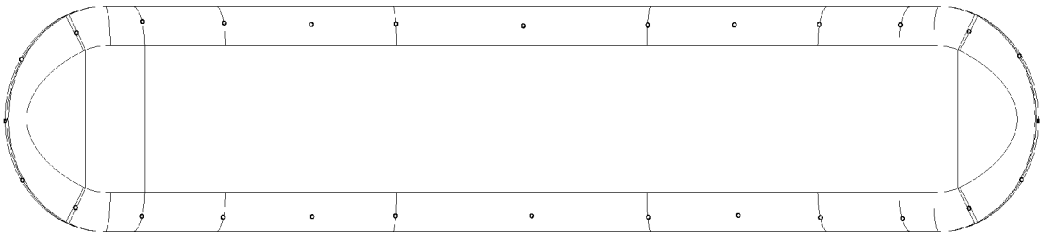
FIG. 8 shows a bottom view of the rinse hanger.

FIG. 8 shows a bottom view of the rinse hanger. The flat bottom ends 106*a*; 106*b* are shown.

Figure 9:
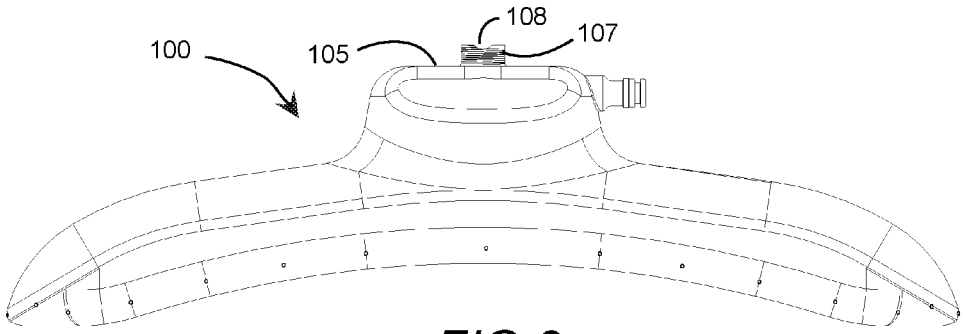
FIG. 9 shows a front view of a hanger body of the rinse hanger.
Figure 10:
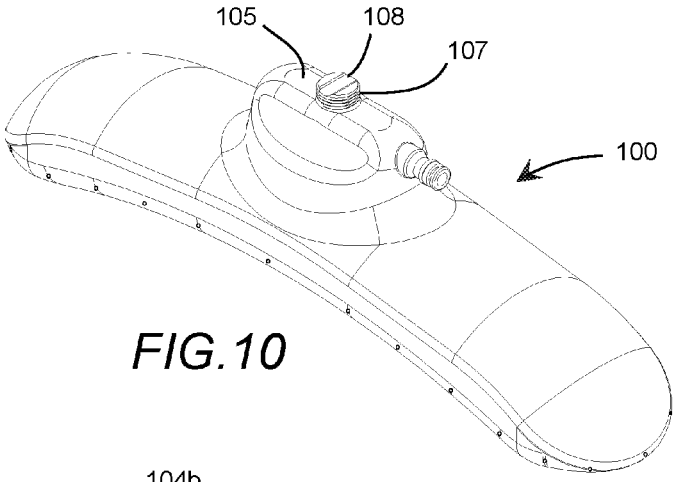
FIG. 10 shows a perspective view of the hanger body.
Figure 11:
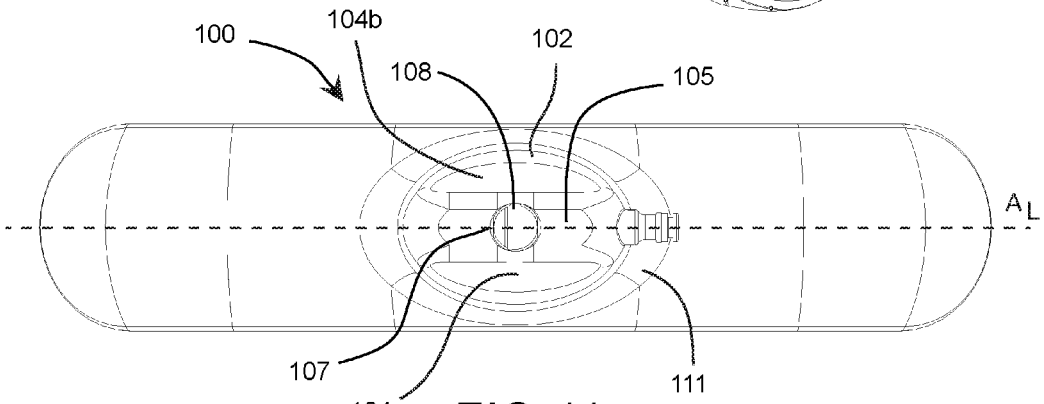
FIG. 11 shows a top view of the hanger body.

FIGS. 9-11 further illustrate the hanger body portion 100.

FIG. 9 shows a front view of a hanger body of the rinse hanger. Without the hook and cap assembly being attached one can see the threaded portion 107 of the hanger body. The threaded portion extends vertically from the longitudinal base portion 105. Threads are disposed about a circumferential side surface of the threaded portion as shown. Along the top side of the threaded portion is disposed a channel 108, the channel extends perpendicular with respect to the longitudinal axis along the top of the threaded portion. With the channel being perpendicular to the longitudinal axis, the hanger body is capable of being molded, since, the hanger body remains symmetrical about the longitudinal plane.

FIG. 10 shows a perspective view of the hanger body. The threaded portion 107 of the hanger body and the channel 108 thereon are further illustrated. The width and depth of the channel are configured to allow the flanged portion of the hook to nest within the channel, such that the hook is not inserted into the volume of the hanger body.

Figure 12:
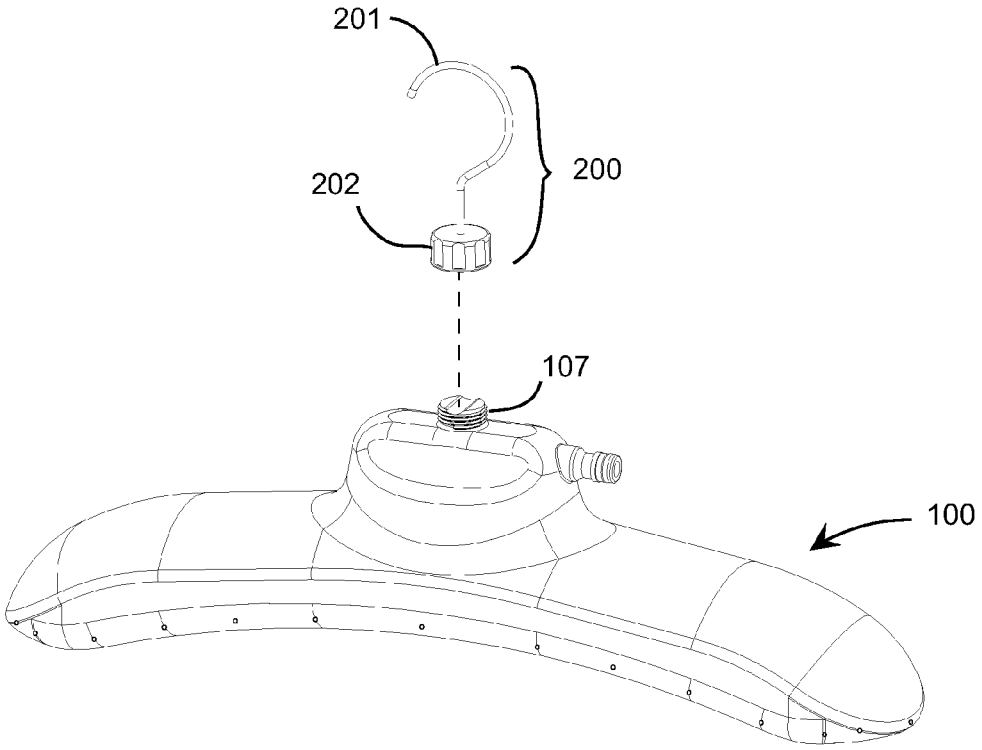
FIG. 12 shows an exploded view of the hanger body and a hook and cap assembly adapted to attach with a threaded portion of the hanger body.

FIG. 11 shows a top view of the hanger body 100. The position and orientation of each of the longitudinal base portion 105, threaded portion 107 of the hanger body and the channel 108 thereon is further illustrated. In addition, the hanger body is shown extending along a longitudinal axis "$A_L$". Moreover, the neck portion 102 comprises a body fillet 111 extending along a bottom circumference of the neck portion where the neck portion meets the center of the hanger body. In addition, the neck portion comprises a pair of opposing longitudinal grooves 104*a*; 104*b* each disposed adjacent to the longitudinal base portion 105, with a first 104*a* of the pair of opposing longitudinal grooves disposed on a first side of the longitudinal base portion, and a second 104*b* of the pair of opposing longitudinal grooves disposed on a second side of the longitudinal base portion opposite the first side. FIG. 12 shows an exploded view of the hanger body 100 and a hook and cap assembly 200 adapted to attach with a threaded portion 107 of the hanger body. The hook and cap assembly includes a hanger hook 201 and a threaded cap 202, wherein the threaded cap is configured to engage the threaded portion of the hanger body as shown.

Figure 13:
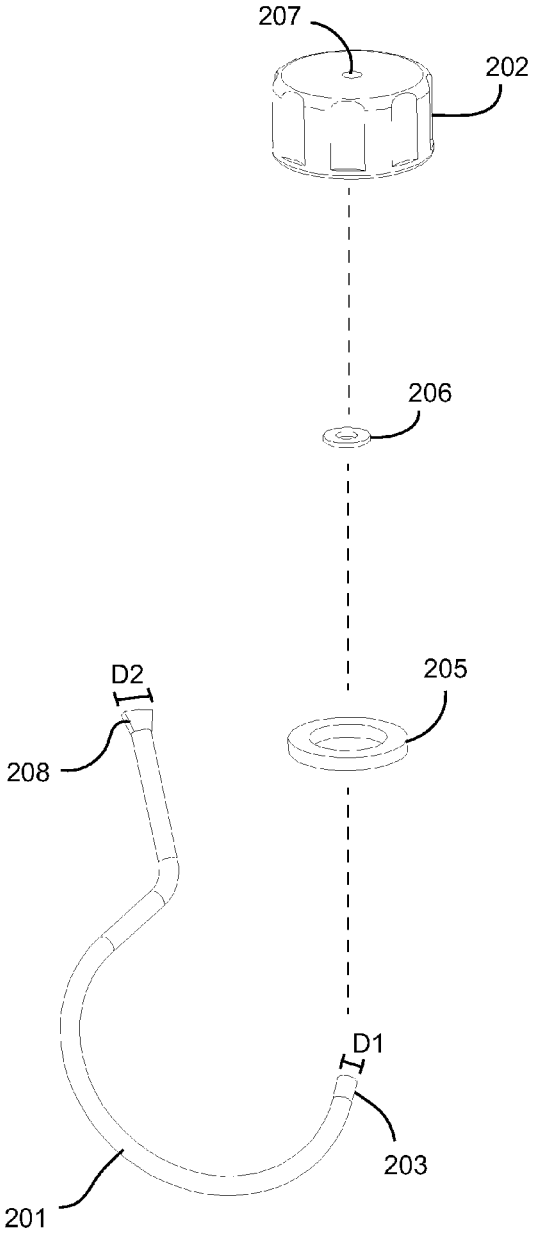
FIG. 13 shows an exploded view of the hook and cap assembly.

FIG. 13 shows an exploded view of the hook and cap assembly. A first end 203 of the hanger hook can be inserted through one or more of: an annular cap seal 205, an optional hook washer 206, and an aperture 207 of the threaded cap 202. A second end of the hanger hook, the bottom terminal end thereof, includes a flanged portion 208 which comprises a diameter D2 that is greater than a diameter D1 of the remainder of the hook. The aperture of the threaded cap has a diameter less than D2 but greater than D1, such that the hook is vertically constrained within the threaded cap forming the hook and cap assembly. Although the size can vary between embodiments, a preferred embodiment includes a first diameter D1 of 4 mm and a second diameter D2 of 4.3 mm. The flanged portion 208 of the hook, or the optional hook washer 206 attached to the hook at the flanged portion, is configured to abut an inside upper surface of the threaded cap 202. The annular cap seal 205 is a rubberized or otherwise pliable seal used to create a friction seal between the threaded cap 202 and the threaded portion 107 of the hanger body (See FIG. 12). The hook is generally curved about an upper side for engaging a standard closet rod or similar hanging object. The hook is preferably formed from stainless steel, however other rigid materials may be similarly used.

Figure 14:
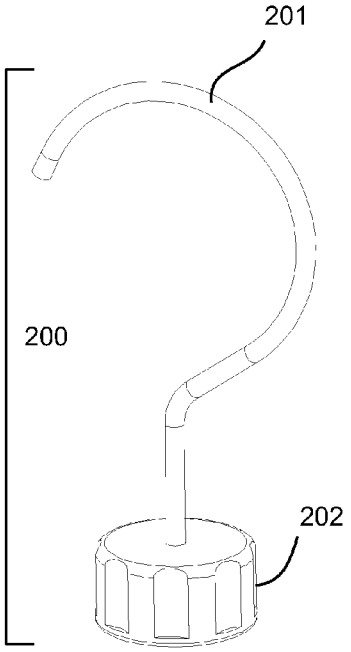
FIG. 14 shows an assembled hook and cap assembly for attaching with the hanger body.
Figure 15:
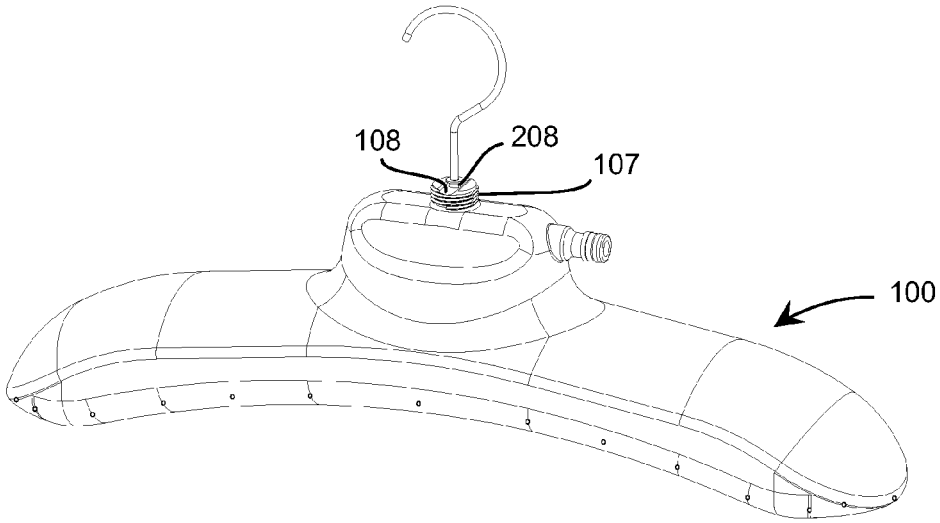
FIG. 15 shows a hanger hook with a flanged portion thereof resting within a channel of the threaded portion of the hanger body, the channel extends perpendicular to the longitudinal plane.

FIG. 14 shows an assembled hook and cap assembly 200 for attaching with the threaded portion 107 of the hanger body 100 (See FIG. 15). While the threads of the cap (inside wall surface thereof) and the corresponding threaded portion of the hanger body can be any size, in the preferred embodiment the thread size is garden hose thread (GHT).

FIG. 15 shows a hanger hook with a flanged portion 208 thereof resting within a channel 108 of the threaded portion 107 of the hanger body; the channel extends perpendicular to the longitudinal plane. The threaded cap is not shown such that a reviewer will appreciate the relation of the flanged portion of the hook with respect to the channel of the threaded portion of the hanger body.

Figure 16:
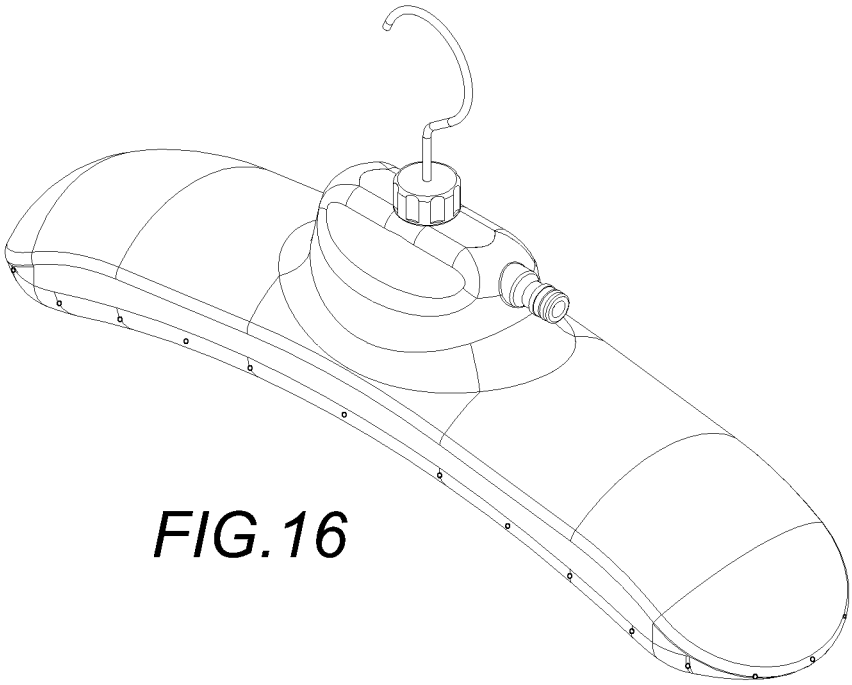
FIG. 16 shows the rinse hanger in accordance with the illustrated embodiment.

FIG. 16 shows the rinse hanger without markings or reference numbers in accordance with the illustrated embodiment.

Figure 17:
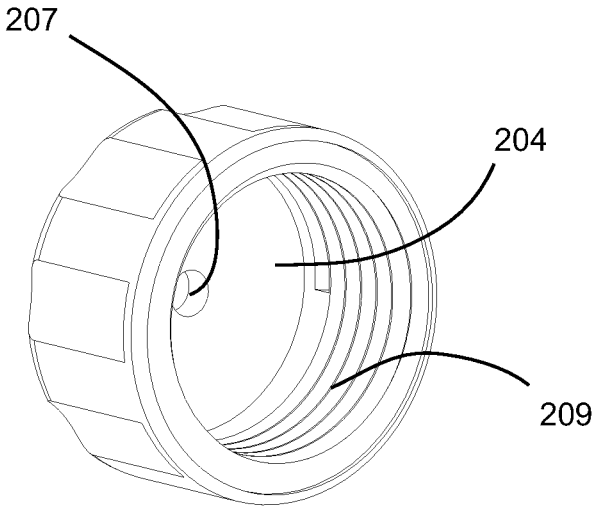
FIG. 17 shows the cap scaled for viewing the cap threads, inside upper surface, and cap aperture.

FIG. 17 shows the cap scaled for viewing the cap threads 209, inside upper surface 204, and cap aperture 207. The annular cap seal is used to form a friction seal between the cap when attached to the threaded portion of the hanger body. The cap threads can be any size, however, in the preferred embodiment the cap thread size is standard garden hose thread (GHT).

In a preferred method of utilization, the wearer can configure the wetsuit inside-out prior to hanging on the rinse hanger. In this regard, the rinse hanger is then configured to rinse the outside of the wetsuit (though configured on the inside surface). After a minute or so of rinsing, the quick connector is detached from the hanger and a spray nozzle is coupled. The spray nozzle is used to rinse the inside of the wetsuit (here configured on the outside since the wetsuit is inside-out).

Other features, embodiments and other variations of the above disclosure will be readily identifiable by those having skill in the art. While the instant disclosure provides detailed descriptions, such descriptions are not intended to limit the spirit and scope of the invention. Rather, the inventive scope shall only be determined through the claims as appended hereto.

INDUSTRIAL APPLICABILITY

The rinse hanger is used to hang, rinse, dry and store a wetsuit or similar garment.

REFERENCE SIGNS LIST hanger body (100)
broad shoulder portions (101*a*; 101*b*)
filleted neck portion (102)
male adapter (103)
longitudinal grooves (104*a*; 104*b*)
longitudinal base portion (105)
flat bottom ends (106*a*; 106*b*)
threaded portion (107)
channel (108)
hanger body holes (109)
O-ring (110)
hook and cap assembly (200)
hanger hook (201)
threaded cap (202)
first end of hook (203)
inside upper surface of cap (204)
annular cap seal (205)
hook washer (206)
cap aperture (207)
flanged portion of hook (208)
cap threads (209)
first diameter (D1)
second diameter (D2)

What is claimed is:

1. A rinse hanger, comprising:

a rigid hollow hanger body extending along a longitudinal axis from a first end to a second end opposite the first end, the hanger body comprising:

a neck portion extending vertically from a center of the hanger body, the neck portion comprising a body fillet extending about a perimeter formed between the neck portion and the hanger body, and further comprising a planar longitudinal base portion disposed at a top end of the neck portion, wherein the longitudinal base portion extends parallel with the longitudinal axis of the hanger body, the neck portion further comprising a pair of opposing separate longitudinal grooves each disposed on the neck portion at a uniform height above the longitudinal axis and oriented parallel with the longitudinal axis, with a first of the pair of opposing separate longitudinal grooves positioned on a first side of the neck portion, and a second of the pair of opposing separate longitudinal grooves positioned on a second side of the neck portion opposite the first side;

a first broad shoulder portion extending from the neck portion to the first end;

a second broad shoulder portion extending from the neck portion to the second end;

a threaded portion extending vertically from the longitudinal base portion, the threaded portion comprising threads disposed about a side wall of the threaded portion and further comprising a channel extending perpendicular to the longitudinal axis along a top surface of the threaded portion;

the hanger body further comprising:

a plurality of holes each disposed about a surface of the hanger body along a periphery thereof, the holes each being configured to communicate water therefrom; and a male adapter extending from the neck portion parallel with the longitudinal axis, the male adapter being configured to couple with a quick release connector and garden hose for receiving a water flow therethrough; and a hook and cap assembly configured to attach to the threaded portion of the hanger body, the hook and cap assembly including:

a hanger hook having a first end and a second end, the hook having a first diameter at the first end and further having a flanged portion at the second end wherein a second diameter associated with the flanged portion is greater than the first diameter;

a cap having threads disposed about an inside wall thereof, and further having a cap aperture disposed through a center of the cap at a top surface thereof, wherein the hanger hook is configured to be inserted through the cap aperture and the flanged portion of the hanger hook is configured to abut an inside upper surface of the cap for retaining the hanger hook therein;

wherein the hanger hook does not extend into a volume of the hanger body; and wherein the hanger hook is configured to swivel about the cap and attached hanger body.

2. The rinse hanger of claim 1, wherein each of the broad shoulder portions have a width between 3 inches and 6 inches.

3. The rinse hanger of claim 1, wherein the male adapter further comprises an O-ring configured to form a seal between the male adapter and the quick release connector.

4. The rinse hanger of claim 1, further comprising a hook washer configured to slide over the first end of the hanger hook and further configured to abut the second end of the hanger hook at the flanged portion, wherein the hook washer is configured to provide an increased diameter for distributing weight about the inside upper surface of the cap.

5. The rinse hanger of claim 1, further comprising an annular cap seal configured to be disposed between the threaded portion of the hanger body and the cap for providing a friction seal therebetween.

6. The rinse hanger of claim 1, further comprising a pair of flat bottom ends, with one of said pair of flat bottom ends being disposed at each end of the hanger body at a bottom side thereof.

7. A rinse hanger, comprising a rigid hollow hanger body extending along a longitudinal axis and adapted to receive and communicate water therethrough, the hanger body comprising a male adapter extending from a neck portion of the hanger body, the male adapter being configured to couple with a quick release connector and garden hose for receiving a water flow therethrough, the hanger body comprising a plurality of holes each disposed about a surface of the hanger body; and a hook and cap assembly including a hook having a flanged end, and a cap having a cap aperture disposed at a center of the cap, wherein the hook and cap assembly is configured to attach with the hanger body for providing a swivel hook function of the rinse hanger;

further characterized in that:

the hanger body comprises a body fillet extending about a perimeter formed between the neck portion and a remainder of the hanger body; and the neck portion further comprises:

a planar longitudinal base portion disposed at a top end of the neck portion, and a pair of opposing separate longitudinal grooves each disposed on the neck portion at a uniform height above the longitudinal axis and oriented parallel with the longitudinal axis, with a first of the pair of opposing separate longitudinal grooves positioned on a first side of the neck portion, and a second of the pair of opposing separate longitudinal grooves positioned on a second side of the neck portion opposite the first side.

8. A rinse hanger, comprising a rigid hollow hanger body extending along a longitudinal axis and adapted to receive and communicate water therethrough, the hanger body having a threaded portion extending vertically from a neck portion thereof, the threaded portion comprising threads disposed on a side wall of the threaded portion; the hanger body comprising a plurality of holes each disposed about a surface of the hanger body; and a hook and cap assembly adapted to attach to the threaded portion of the hanger body for providing a swivel hook wherein the hook of the hook and cap assembly does not extend within a volume of the hanger body;

the rinse hanger being further characterized in that:

the neck portion comprises:

a body fillet extending about a perimeter formed between the neck portion and a remainder of the hanger body;

a planar longitudinal base portion disposed at a top end of the neck portion; and a pair of opposing separate longitudinal grooves each disposed on the neck portion at a uniform height above the longitudinal axis and oriented parallel with the longitudinal axis, with a first of the pair of opposing separate longitudinal grooves positioned on a first side of the neck portion, and a second of the pair of opposing separate longitudinal grooves positioned on a second side of the neck portion opposite the first side.

9. The rinse hanger of claim 8, wherein a vertical plane extending along the longitudinal axis defines a longitudinal plane.

10. The rinse hanger of claim 9, wherein the threaded portion of the hanger body further comprises a channel for receiving a portion of the hook therein, the channel being disposed along a top surface of the threaded portion, wherein a volume within the channel does not form part of the volume associated with the hanger body.

11. The rinse hanger of claim 10, wherein the channel is oriented perpendicular with respect to a longitudinal axis associated with a length of the hanger body.

12. The rinse hanger of claim 9, further comprising a male adapter extending from a neck portion of the hanger body in a direction parallel with the longitudinal axis, the male adapter being configured to couple with a quick release connector and garden hose for receiving a water flow therethrough.

13. The rinse hanger of claim 9, wherein the hanger body is symmetrical about the longitudinal plane.

14. The rinse hanger of claim 8, further comprising a pair of flat bottom ends, with one of said pair of flat bottom ends being disposed at each end of the hanger body at a bottom side thereof.

15. The rinse hanger of claim 8, the hanger body comprising a pair of broad shoulder portions each disposed on opposite sides of the hanger body, wherein the broad shoulder portions each have a width between 3 inches and 6 inches.

* * * * *